United States Patent [19]

McGinnis

[11] Patent Number: 4,602,610

[45] Date of Patent: Jul. 29, 1986

[54] DUAL-RATE FUEL FLOW CONTROL SYSTEM FOR SPACE HEATER

[76] Inventor: George P. McGinnis, 3426 Hammerberg, Flint, Mich. 48507

[21] Appl. No.: 229,970

[22] Filed: Jan. 30, 1981

[51] Int. Cl.[4] ..... F24H 3/02

[52] U.S. Cl. ..... 126/110 E; 126/116 A; 236/11

[58] Field of Search ..... 126/116 A, 110 E; 236/11, 10

[56] References Cited

U.S. PATENT DOCUMENTS

| | | | |
|---|---|---|---|
| 2,266,563 | 8/1939 | McCorkle | 236/11 |
| 2,271,120 | 1/1942 | Grant | 236/11 |
| 2,286,296 | 6/1942 | McGrath | 236/11 |
| 2,289,206 | 7/1942 | Nessell | 126/116 A |
| 2,308,555 | 1/1943 | Tate | 236/11 |
| 2,321,852 | 6/1943 | Ray | 236/11 |
| 2,322,405 | 6/1943 | White | 236/11 |
| 2,416,766 | 3/1947 | Miller | 126/116 A |
| 2,521,866 | 9/1950 | Ott | 236/11 |
| 2,693,914 | 11/1954 | Payne | 236/11 |
| 2,704,571 | 3/1955 | Reichelderfer | 236/11 |
| 2,800,282 | 7/1957 | Calahan | 236/11 |
| 2,909,218 | 10/1959 | Matthews | 236/9 R |
| 3,057,340 | 10/1962 | Fritts | 126/110 E |
| 3,486,693 | 12/1969 | Stang, Jr. et al. | 236/11 |
| 3,999,934 | 12/1976 | Chambers et al. | 431/63 |

*Primary Examiner*—James C. Yeung

*Attorney, Agent, or Firm*—Hauke and Patalidis

[57] ABSTRACT

A dual-rate fuel flow control system for the gaseous or liquid fuel supplied to the burner of a space heater, comprising a valve controllable to supply full fuel flow to the burner at the start of a heating cycle to deliver full heat to the heat exchanger chamber in which circulates the heat transfer fluid, and controllable to supply reduced fuel flow to the burner simultaneously with starting the circulating of the heat transfer fluid from the heat exchanger to the space to be heated.

7 Claims, 6 Drawing Figures

DUAL-RATE FUEL FLOW CONTROL SYSTEM FOR SPACE HEATER

CROSS REFERENCE TO RELATED APPLICATION

This application is related to its divisional application Ser. No. 492,814, filed May 9, 1983, now U.S. Pat. No. 4,485,965, issued Dec. 4, 1984.

BACKGROUND OF THE PRESENT INVENTION

The present invention relates to space heaters and more particularly to a dual-rate fuel control system for space heaters providing improved thermal efficiency and fuel economy.

Warm air, hot water and steam space heaters are now in general use. Such space heaters comprise, according to the type of heat transfer fluid being used, a fan or blower for delivering heated air from a furnace heat exchanger to various rooms or spaces to be heated in a building, or a hot water circulation pump or steam flow valving system for circulating hot water or steam to diverse radiators in the various spaces to be heated. Generally, the heating system includes a control thermostat disposed in one of the spaces to be heated, or a thermostat in each space to be heated co-operating with appropriate individual controls for valving means, blower motors or circulation pump motors. The control thermostat causes the burner of the furnace to start when heat is called for as a result of the temperature dropping below a predetermined "low". As soon as the heat transfer fluid in the heat exchanger chamber reaches a predetermined temperature, a fan or blower in warm air systems, a circulation pump in hot water systems or a valve in steam systems, is automatically activated for circulating heated air through the rooms or spaces to be heated, or for circulating hot water or steam through the appropriate radiators. When the temperature in the room or spaces to be heated reaches a predetermined "high" temperature, the thermostat automatically shuts off the supply of fuel to the furnace burner, but the heat transfer fluid continues to circulate until the temperature of the fluid in the heating chamber, or in the boiler, has dropped below a predetermined temperature.

Dual-range heating systems have been proposed in the past. For example, U.S. Pat. No. 2,693,914 discloses a warm air furnace system in which the burner has a high setting and a low setting, and in which part of the air heated during operation of the burner at low setting is by-passed through the heating chamber. U.S. Pat. No. 2,800,282 discloses a dual burner and a control system for operating only one burner when the outside temperature is above a predetermined temperature, and for operating both burners when the outside temperature is below the pre-determined temperature. U.S. Pat. No. 2,266,563 teaches an arrangement for monitoring the temperature in a hot air duct such as to reduce the heat input from the burner when the temperature in the duct becomes excessive, and such as to return the burner to full capacity when the temperature in the duct drops. U.S Pat. No. 3,486,693 discloses a modulating fuel flow control providing a variation or modulation of the flow of fuel to a burner as a function of the variation of temperature in the space to be heated, while U.S. Pat. No. 3,999,934 discloses a thermostat control which provides full fuel flow to a burner during start-up and which reduces the flow of fuel to the burner after start-up.

Although attempts have thus been made in the past to effectuate fuel economy and energy saving in space heating systems, such attempts have apparently not met with great commercial success in view of their relative complication, sometimes coupled with lack of reliability and high cost of installation. The present invention, by contrast, derives from the observation that it is more efficient to transfer small amounts of heat through a heat exchanger than to transfer large amounts of heat through the same heat exchanger and that, after start-up of the heating system, a smaller amount of heat being supplied to the heat exchanger is only required for maintaining the system in an efficient mode of operation.

SUMMARY OF THE INVENTION

The present invention accomplishes its diverse objects and presents its many advantages by providing a dual-range heating system utilizing no auxiliary controls, and utilizing only the controls available in conventional space heating system. The only modification to a conventional heating system is the installation of a by-pass line to the fuel line supplying fuel to the burner, a single simple solenoid-actuated on-off valve being disposed in the by-pass fuel line, the on-off valve being operated by the conventional thermostat control turning on and off the fan or blower motor, in warm air systems, or turning on and off the circulation pump motor in hot water system. When the valve, normally on, is turned off simultaneously with starting the transfer fluid circulation, it provides for reduced fuel flow to the burner. Alternatively a dual-flow rate valve may be connected directly in the fuel supply line.

The diverse objects and advantages of the present invention will become apparent to those skilled in the art when the following description of the best modes contemplated for practicing the invention is read in conjunction with the accompanying drawing wherein like reference numerals refer to like or equivalent parts and in which:

DETAILED DESCRIPTION OF THE SPECIFIC EMBODIMENTS ILLUSTRATED

Figure 1:
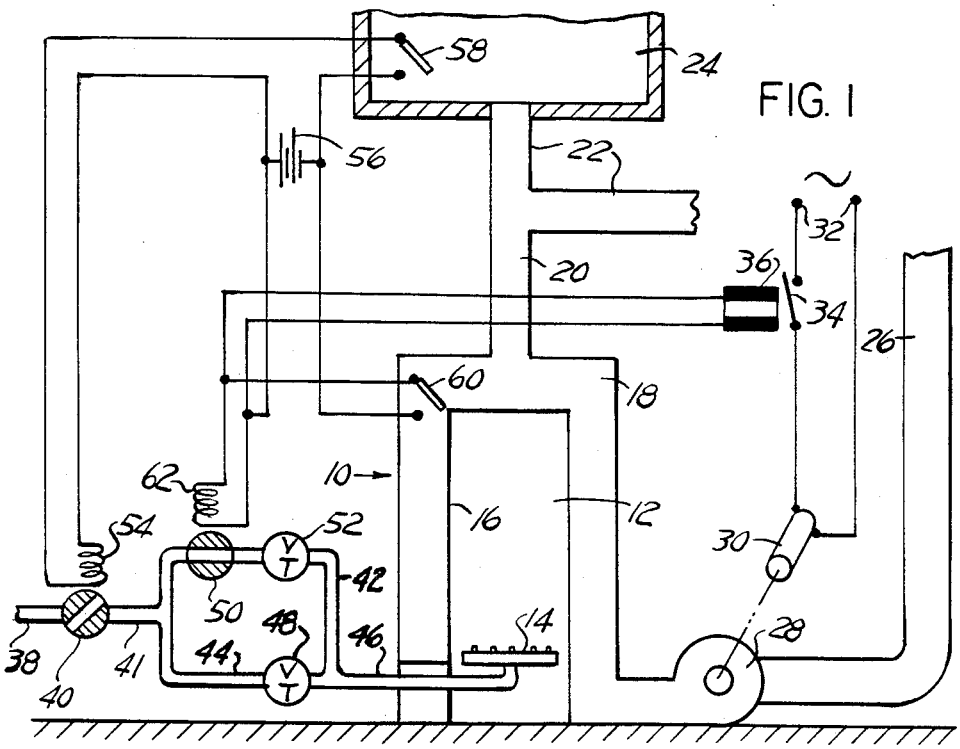
FIG. 1 is a schematic representation of an example of hot air heating system incorporating the dual-rate fuel flow system of the invention, shown in a stand-by mode.

The present invention is illustrated in the drawing, and is described hereinafter, as incorporated in a specific example of forced air heating system. It will be appreciated that the principle of the present invention can be incorporated in any heating system wherein a fluid other than air, such as a liquid (hot water) or a liquid vapor (steam) fluid is used as a heat transfer medium between the heat exchanger of a furnace and a heat exchanger radiating element in a space to be heated.

Referring now to the drawing, and more particularly to FIG. 1, a forced air heating system is illustrated as comprising a furnace 10 having a combustion or burner chamber 12 in which is disposed a conventional fuel burner, such as a gas burner 14 for example. The walls 16 of the combustion or burner chamber 12 form a heat exchanger between the burner chamber 12 and an air circulation or heating chamber 18 surrounding the burner chamber 12. The air circulation or heating chamber 18 is provided with an outlet duct 20 having in turn a plurality of branch ducts 22 for supplying circulating warm air to appropriate rooms or spaces 24 in a building. Air from the rooms or spaces 24 is returned to the furnace heating chamber 18 by an appropriate return outlet in each room or space connected to an appropriate return duct 26. Air is kept in circulation, when required, through the system from the return duct 26 to the outlet duct 20 by a fan or blower 28 driven by an electric motor 30 connected across electrical supply terminals 32 through a switch 34 operated by a relay 36.

The burner 14 disposed in the combustion chamber 12 is supplied in fuel, such as natural or bottled gas for example, from a main fuel line 38 through a normally "off" valve 40, a supply line 41 and a pair of parallel connected by-pass lines 42 and 44 leading into a common outlet line 46 connected to the inlet of the burner 14. The by-pass line 44 may be provided with a calibrated orifice to limit the flow of fuel therethrough or, in the alternative and as illustrated, it is provided with a manually adjustable valve 48, to provide manual adjustment of the flow of fuel through the branch or by-pass 44. The other branch or by-pass line 42 is provided with a normally "on" valve 50, and may be provided, if so desired, with either a calibrated orifice to limit the flow of fuel therethrough, or with a manually adjustable flow valve 52 as illustrated.

The normally "off" main valve 40 is operable to an "on" position by an appropriate relay shown in the form of a solenoid 54 capable of being energized from an electrical power source 56 through a room thermostat 58 disposed in the room 24. A thermostat 60 is disposed in the heating chamber 18 and is arranged, upon closure, to energize the relay 36 operating the switch 34 of the blower motor 30, simultaneously with energizing a relay 62 operating the normally "on" valve 50 to its "off" mode, thus interrupting the flow of fuel through the branch or by-pass line 42.

A continuously "on" pilot light, not shown, is associated with the burner 14, as is conventional, for lighting the fuel flowing through the nozzles of the burner 14, when the burner is supplied with fuel.

In the stand-by mode, illustrated at FIG. 1, that is when there is no requirement for heat to be supplied to the room 24, the room thermostat 58 is open, the main fuel supply valve 40 is "off" and the by-pass fuel valve 50 is "on". The heating chamber thermostat 60 is open, and the switch 34 of the blower motor relay 36 is open.

Figure 2:
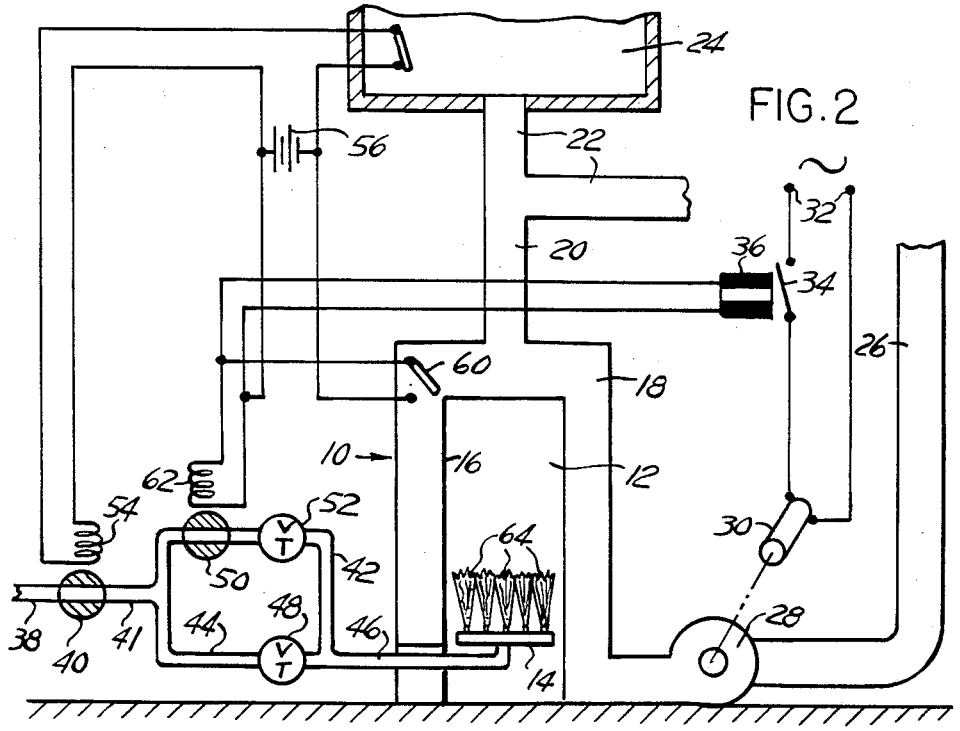
FIG. 2 is the heating system of FIG. 1 shown in operation at the beginning of a heating cycle.

When heat is called upon, the room thermostat 58 closes the circuit of the relay or solenoid 54 of the normally "off" main fuel flow valve 40 which is thus caused to be turned "on", FIG. 2. Fuel thus flows through both branch or by-pass lines 42 and 44, as the valve 50 is normally "on", and full fuel flow is provided through the fuel line 46 to the burner 14. The fuel flowing through the burner nozzles is lit by the pilot light, not shown, thus causing a high heating rate of the heating chamber 18, such high heating rate being arbitrarily represented by high flames 64 from the burner 14. Until the heating chamber 18 reaches a predetermined temperature for which the heating chamber thermostat 60 is set, the thermostat 60 remains open, the blower motor switch 34 remaining open and no air is circulated through the heating chamber 18.

Figure 3:
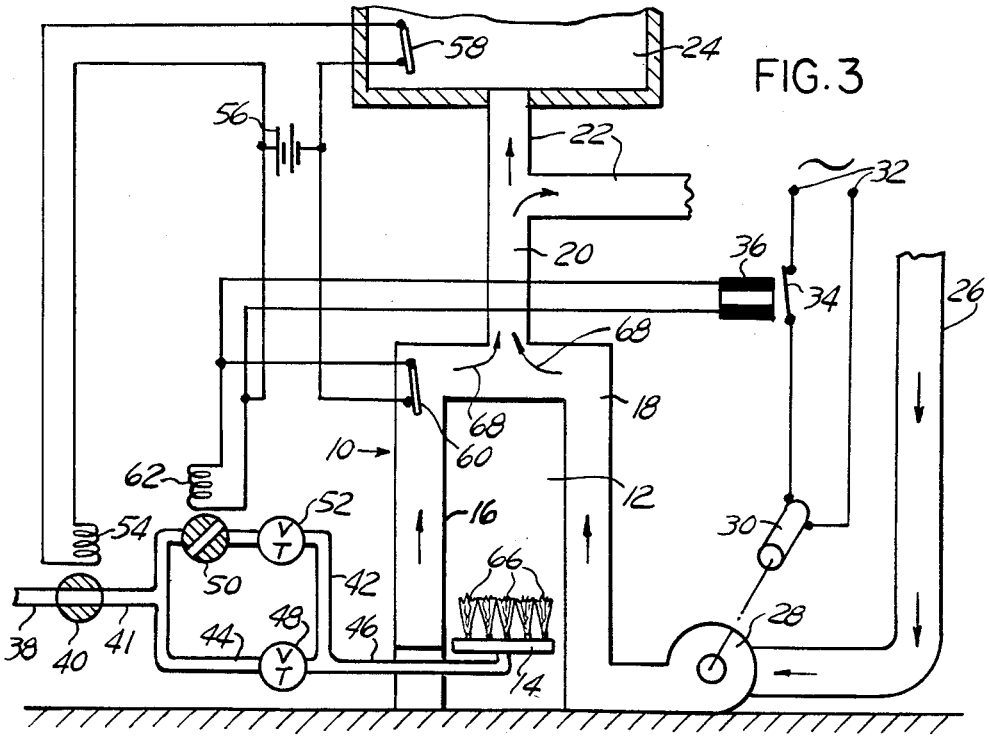
FIGS. 3 and 4 are respectively representations of the heating system of FIG. 1 shown in operation respectively during and at the end of the heating cycle.

As soon as the temperature in the heating chamber 18 reaches the temperature for which its thermostat 60 is set, the thermostat 60 closes, FIG. 3. Closure of the thermostat 60 activates simultaneously the relay 36 closing the switch 34 of the blower motor 30, such that air is circulated through the system by the blower 28, as arbitrarily represented by arrows 68. Simultaneously therewith, the closure of the heating chamber thermostat 60 activates the relay or solenoid 62 of the normally "on" by-pass valve 50, thus operating the valve 50 to its "off" position. The main fuel valve 40 remains "on", due to the room thermostat 58 remaining closed, but fuel is nevertheless prevented from flowing through the by-pass line 42 because the valve 50 is "off" and only fuel flowing through the calibrated by-pass line 44 to the line 46 is supplied to the burner 14. The amount of fuel being supplied to the nozzles of the burner 14 is thus reduced, in turn reducing the amount of heat in the combustion chamber 12 being transferred through the walls 16 of the combustion chamber to the heating chamber 18. The reduced heat supplied by the burner 14 is arbitrarily represented by the reduced height flames 66 in the combustion chamber 12.

It has been found that, in most heating systems, reducing the fuel flow to the burner 14 by 25% simultaneously with starting the air circulation through the heating chamber 18 to supply warm air to the rooms or spaces to be heated does not result in any decrease in over-all heating efficiency, and of course results in a saving of approximately 20% in fuel costs. The division of fuel flow between the two by-pass lines 42 and 44, or the ratio of full to partial fuel flow, is effected by placing an appropriate calibrated orifice in the branch or by-pass line 44 or, when a manually adjustable valve 48 is mounted in series in the by-pass line 44, by appropriately adjusting the flow through the adjustable valve 48 to provide a rate of flow through the by-pass line 44 which is for example 25%, or any other appropriate ratio, that of the full flow rating of the main fuel valve 40.

Figure 4:
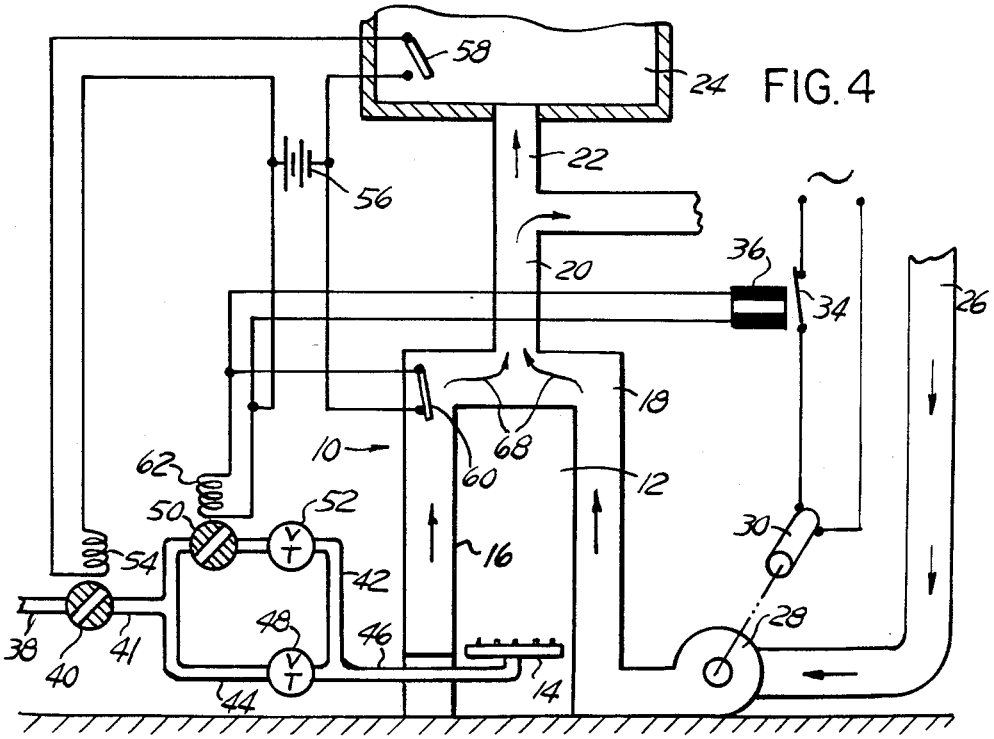

When the temperature in the room or space 24 reaches the predetermined temperature for which the room thermostat 58 has been set to open, FIG. 4, opening of the room thermostat 58 de-activates the main valve relay or solenoid 54, such that the main fuel valve 40 returns to its normally closed, or "off", position, thus shutting off the fuel supply to the burner 14. However, the heating chamber thermostat 60 remains closed for a short period of time until the ambient temperature in the heating chamber 18 drops to a sufficient level, with the result that air continues to circulate through the heating chamber 18, is heated by the walls 16 remaining hot in the chamber and is supplied to the rooms or spaces to be heated for a short period of time. When the heating chamber thermostat 60 opens, the relay 36 of the blower motor switch 34 is activated, therefore opening the switch 34 and stopping the blower 28. This in turn stops the circulation of air through the heating chamber 18, while simultaneously returning the valve 50 to its normally "on" position when the thermostat 60 opens. The system is therefore returned to the beginning of the heating cycle hereinbefore described, or to the stand-by mode depicted at FIG. 1.

It will be readily appreciated by those skilled in the art that the dual-range burner heating system of the present invention has applications for any type of heating systems, irrespective of the fuel being used, whether it is a gaseous fuel as natural gas or a liquified fuel (LPG), or whether it is a liquid fuel such as kerosene, heating oil and the like. It will further be appreciated that the invention has also applications to heating systems other than forced air heating systems, such as hot water heating systems or steam heating systems, a water circulation pump or a steam flow control valve being substituted for the circulation air blower arrangement herein described and illustrated.

Figure 5:
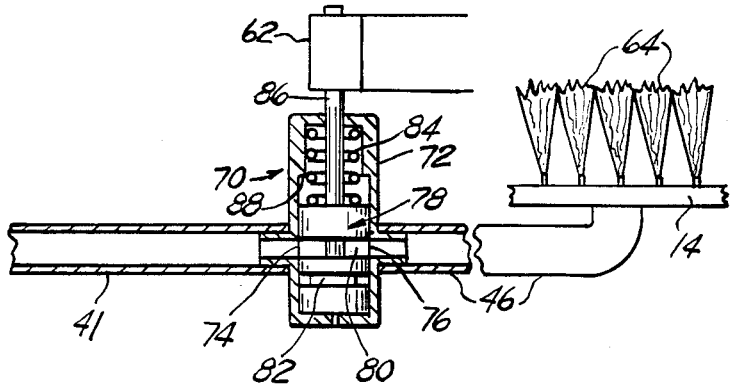
FIGS. 5 and 6 are schematic illustrations in section of a dual-range fuel flow valve according to the present invention, showing the two modes of operation of the valve.
Figure 6:
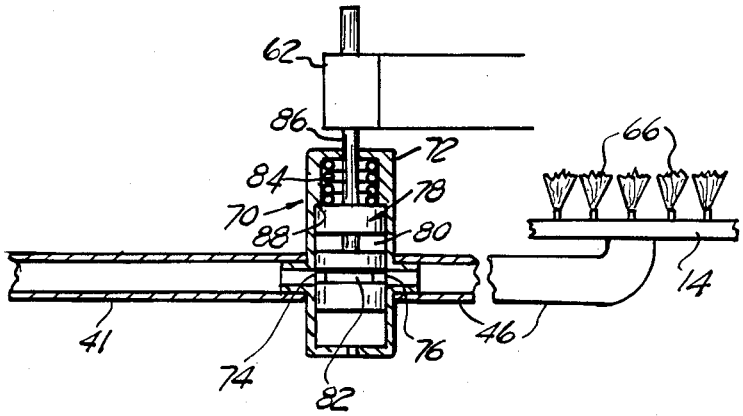

Instead of providing a pair of parallel connected by-pass lines 42 and 44 between the fuel supply lines 41 and 46, one by-pass line providing reduced fuel flow, and the other having an on-off valve providing full fuel flow to the burner when "on", a dual-flow rate control valve may be connected in series between fuel supply lines 41 and 46. Such a single dual-flow rate control valve may take the form of the valve disclosed in U.S. Pat. No. 2,909,218, for example, or may be a simple spool valve 70 as illustrated at FIGS. 5–6.

The valve 70 has a housing 72 having an inlet orifice or port 74 connected to the fuel supply line 41 and an outlet orifice or port 76 connected to the fuel outlet line 46 to the burner 14, a spool 78 being slidably disposed within the bore of the housing 72. The spool 78 is provided with a relatively wide groove 80 providing full fuel flow from the inlet port 74 to the outlet port 76, and a relatively narrow groove 82 providing reduced fuel flow from the inlet port 74 to the outlet port 76 when the spool is displaced from the position illustrated at FIG. 5 providing full fuel flow to the position illustrated at FIG. 6 providing reduced fuel flow. The spool 78 is normally urged by a coil spring 84 to the position of FIG. 5 providing full fuel flow. The spool 78 has an integral plunger 86 projecting from the housing 72 surrounded by the winding of the solenoid 62. When the solenoid 62 is energized, that is when the heating chamber thermostat 60, FIGS. 1–4, is closed, thus starting the air circulation blower motor 28 or, alternatively, the hot water circulation pump, the spool 78 is displaced against the bias of the spring 84 until it abuts a shoulder 88 formed in the bore of the valve housing 72, thus displacing the spool 78 to the position causing reduced fuel flow from the inlet port 74 to the outlet port 76 of the valve 70 through the reduced flow groove 82 of the spool, FIG. 6.

It will be readily apparent that the embodiments of the invention disclosed are well calculated to accomplish the objects of the invention, and it will be appreciated that the invention is capable of modifications, variations and changes without departing from the scope of the invention as stated in the claims.

What is claimed as new is as follows:

1. In a space heating system having a furnace provided with a fuel burner for heating a heat transfer fluid circulating through a chamber in said furnace and a fuel line supplying fuel to said burner, said chamber being provided with thermostatic control for starting circulation of said fluid at a first predetermined temperature in said chamber and for stopping circulation of said fluid at a second predetermined temperature in said chamber, the improvement comprising means in said fuel line operated by said thermostatic control for reducing fuel flow to said burner simultaneously with starting said fluid circulation.

2. The improvement of claim 1 wherein said means comprises a normally "on" dual-flow rate valve normally providing full fuel flow therethrough operable by said thermostatic control to provide reduced fuel flow therethrough.

3. The improvement of claim 1 wherein said means comprises a normally "on" valve, control means for turning said valve "off" upon energizing by said thermostatic control, and a calibrated by-pass line by-passing said valve, said by-pass line supplying reduced fuel flow to said burner.

4. The improvement of claim 3 further comprising manually adjustable flow rate means disposed in said by-pass line.

5. The improvement of claim 1 wherein said fluid is atmospheric air.

6. The improvement of claim 1 wherein said fuel is a gaseous fuel.

7. The improvement of claim 1 wherein said fuel flow is reduced by about 25%.

* * * * *